US006786665B2

(12) United States Patent
Hwang et al.

(10) Patent No.: US 6,786,665 B2
(45) Date of Patent: Sep. 7, 2004

(54) PRINTER MEDIA TRAY AND METHOD OF USING SAME

(75) Inventors: Peter G. Hwang, Vancouver, WA (US); Raymond C. Sherman, Camas, WA (US); Michael J. Allison, Brush Prairie, WA (US); Allan G. Olson, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/736,658

(22) Filed: Dec. 15, 2003

(65) Prior Publication Data

US 2004/0126174 A1 Jul. 1, 2004

Related U.S. Application Data

(63) Continuation of application No. 10/014,941, filed on Oct. 26, 2001, now Pat. No. 6,676,318.

(51) Int. Cl.[7] ..... B41J 3/39
(52) U.S. Cl. ..... 400/693; 400/691
(58) Field of Search ..... 400/693, 691, 400/595, 624; 271/3.03

(56) References Cited

U.S. PATENT DOCUMENTS

| | | | | |
|---|---|---|---|---|
| 4,808,021 | A | 2/1989 | Kelly | |
| 5,033,892 | A | 7/1991 | Tumuraya et al. | |
| 5,343,223 | A | 8/1994 | Tohyama et al. | |
| 5,475,413 | A | 12/1995 | Hashimoto et al. | |
| 5,573,235 | A | 11/1996 | Asai | |
| 6,290,349 | B1 | 9/2001 | Silverbrook et al. | |
| 6,494,633 | B1 | 12/2002 | Crosby et al. | |
| 6,659,667 | B2 * | 12/2003 | McCue et al. | 400/625 |

FOREIGN PATENT DOCUMENTS

| | | |
|---|---|---|
| EP | 1148013 | 10/2001 |

* cited by examiner

*Primary Examiner*—Anthony H. Nguyen

(57) ABSTRACT

A printer having a housing, including a bottom wall, a front wall, and a cover pivotally attached to the housing and rotatable between an open and a closed position. A tray is provided for supporting print media from below wherein the tray is pivotally attached to the housing for movement between a printer operational position and a printer non-operational position, wherein the tray is disposed between the cover and the front wall when the tray is in the printer non-operational position.

13 Claims, 3 Drawing Sheets

PRINTER MEDIA TRAY AND METHOD OF USING SAME

This application is a continuation of and claims the priority of an application entitled PRINTER MEDIA TRAY AND METHOD OF USING SAME, application Ser. No. 10/014,941 filed Oct. 26, 2001 which is now U.S. Pat. No. 6,676,318.

BACKGROUND OF THE INVENTION

The present invention relates generally to inkjet printers and, more particularly, to print media trays utilized in such printers.

Printers of various types are virtually universally known. They are operated daily in thousands of business organizations, university campuses and homes. Many such printers utilize a front-loading print media input/output tray. Often, the tray projects from the printer housing, thereby increasing the space, or footprint, occupied by the printer. Such an increased footprint may be tolerable during periods of printer operation but can present problems during times of printer non-operation.

In this regard, packaging and shipping costs are sometimes increased because of the additional space occupied by the forward projecting tray. In addition, increased costs are realized by wholesalers and retailers in the form of increased shelf space. Of course, the large footprint is inconvenient for the printer user because of the space occupied by the projecting tray during periods of printer non-operation.

The above limitations have been recognized and attempts have been made to mitigate them. In some cases, the printer and media tray are packaged and shipped separately in an attempt to reduce container size. While this technique can lead to some space savings, it introduces the disadvantage of requiring assembly of the printer before operation and in addition, runs the risk of the tray getting lost in the process.

In view of the foregoing, it would be desirable to have a printer and print media tray combination having a reduced footprint relative to that of conventional printers without a need to separate the printer and tray during periods of non-operation. Desirably, such a combination would enable reduced packaging and shipping costs while increasing value to the user by reducing product footprint during non-operation periods.

DISCLOSURE OF THE INVENTION

According to the present invention, there is provided a printer having a housing, including a bottom wall, a front wall, and a cover pivotally attached to the housing and rotatable between an open and a closed position. A tray is provided for supporting print media from below wherein the tray is pivotally attached to the housing for movement between a printer operational position and a printer non-operational position, wherein the tray is disposed between the cover and the front wall when the tray is in the printer non-operational position.

The present invention affords several advantages. Conservation of valuable shipping and shelf space is achieved. In addition, flexibility of print media tray length can be realized so that a variety of differing media sizes may be utilized by the printer. In addition, when the tray is positioned inside the cover the tray functions as a compression member to support the printer structurally during bulk-pack and as a carriage restraint during shipping.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
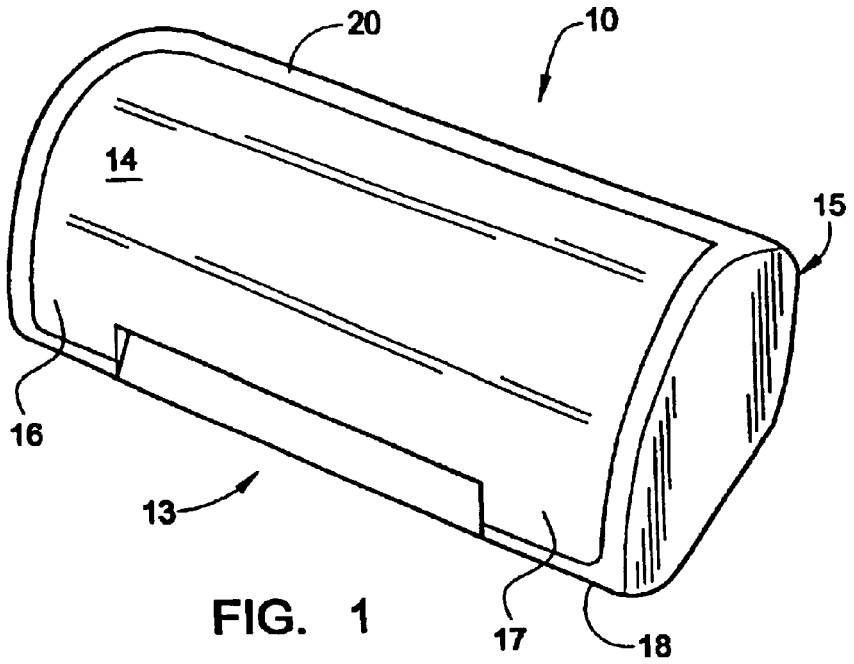
FIG. 1 is a front elevational view of a printer that is constructed according to the present invention.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to embraced within their scope.

In the following detailed description and in the several figures of the drawings, like elements are identified with like reference numerals.

Referring now to the drawings, there is shown a novel printer 10 that is constructed according to the present invention. The printer 10 includes a housing 15 having top wall 20, a front wall 12 and a bottom wall 18. A cover 14 is pivotally attached to the top wall 20 for rotation into a printer operational position or into a printer non-operational position. A print media tray 13, mounted on the front wall for rotatable movement, also moves into and out of a printer operational position and a printer non-operational position.

The printer non-operational position is shown in FIG. 1. In this case, the printer is closed up with the cover 14 overlying the print media tray 13. In this configuration, the printer 10 occupies a compact footprint that conserves packaging and space during shipment while the tray 13 acts as a compression member to support the printer structurally. At its destination, of course, the compact package presented by the printer 10 results in a smaller product footprint on the user's desk, as compared to conventional printers.

Figure 2:
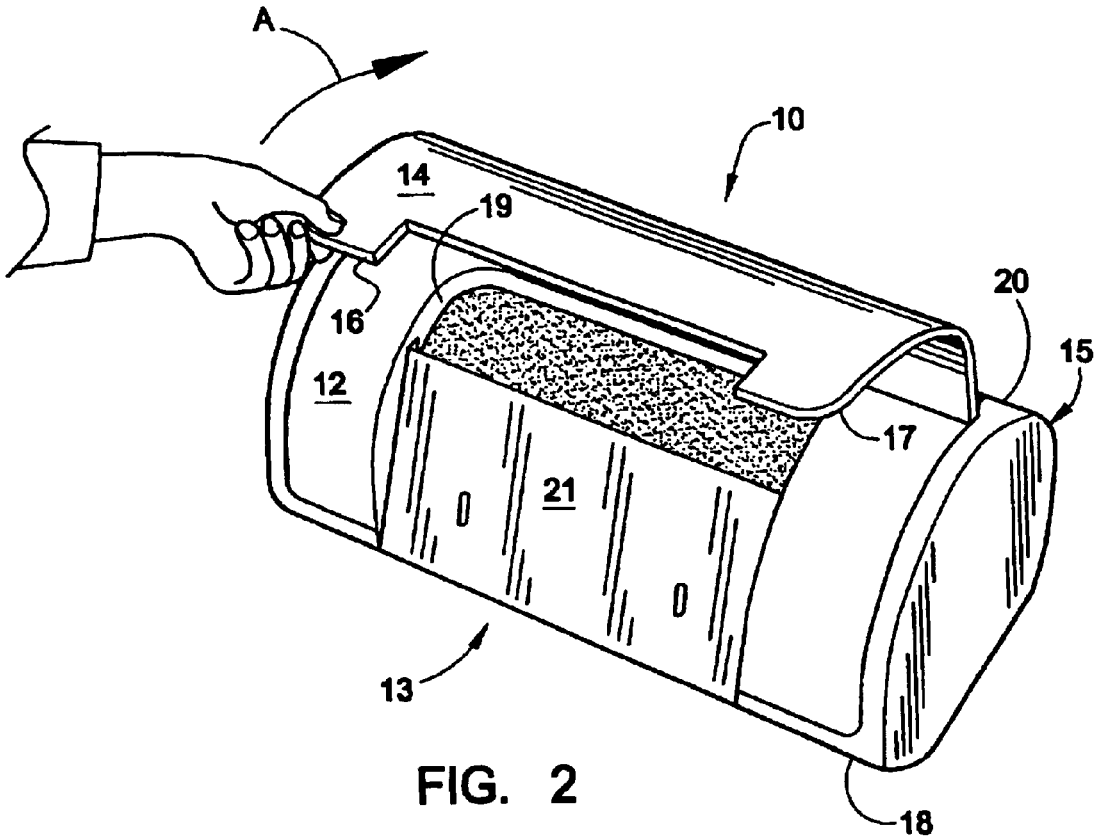
FIG. 2 is a front elevational view of the printer of FIG. 1 showing the cover in a partially raised position.
Figure 3:
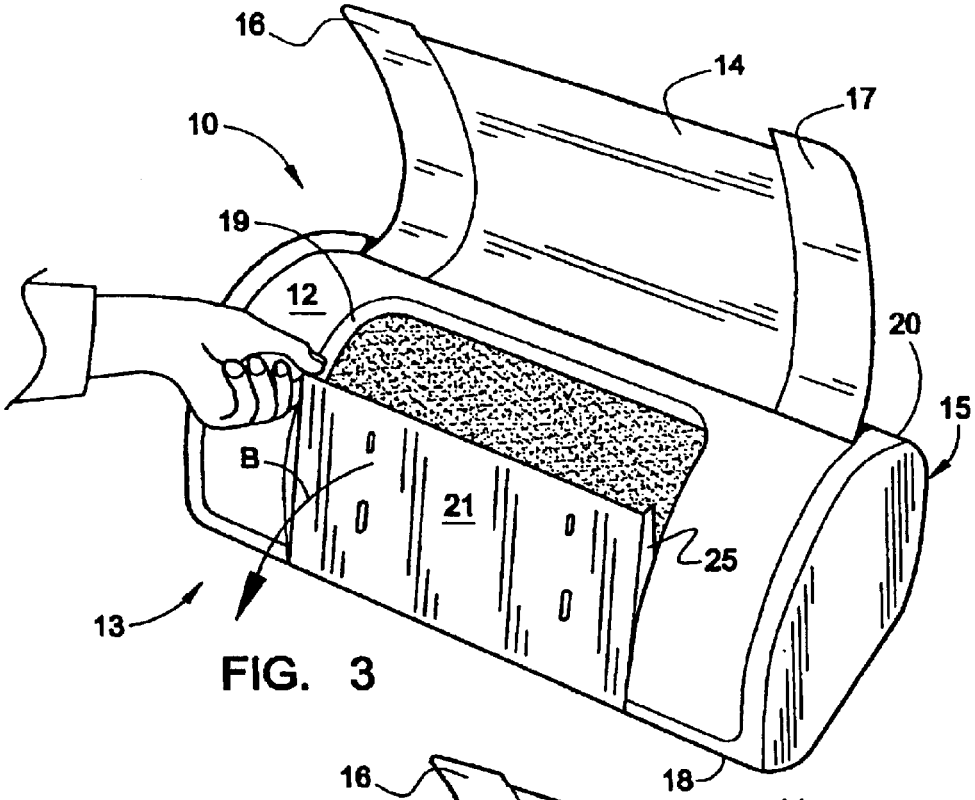
FIG. 3 is a front elevational view of the printer of FIG. 1 showing the cover in a fully raised position.
Figure 4:
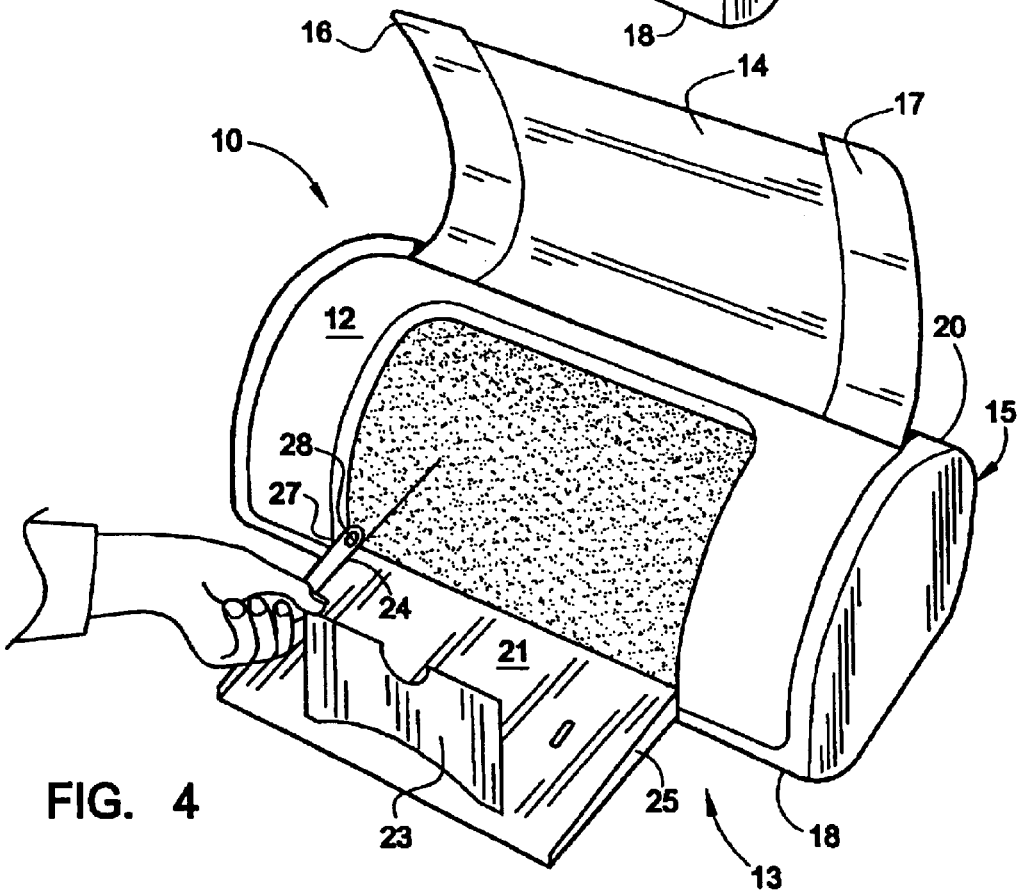
FIG. 4 is a front elevational view of the printer of FIG. 1 showing the position of the cover as the print media tray is being moved into the printer operational position.

In converting the printer 10 from a non-operational position to an operational position, the steps shown in FIGS. 2–4 are followed. First, the cover 14 is grasped at a finger engageable tab 16 or 17 and the cover 14 is rotated upwardly, as shown generally by the arrow A. With the cover 14 fully rotated, the tray 13 can be grasped at a flat tray body 21 which is then rotated in a manner shown generally by the arrow B. It will be noted that in rotating from the non-operational position to the operational position, the tray 13 moves from a substantially perpendicular relationship to the plane of the bottom wall 18, to a substantially parallel relationship therewith.

Figure 5:
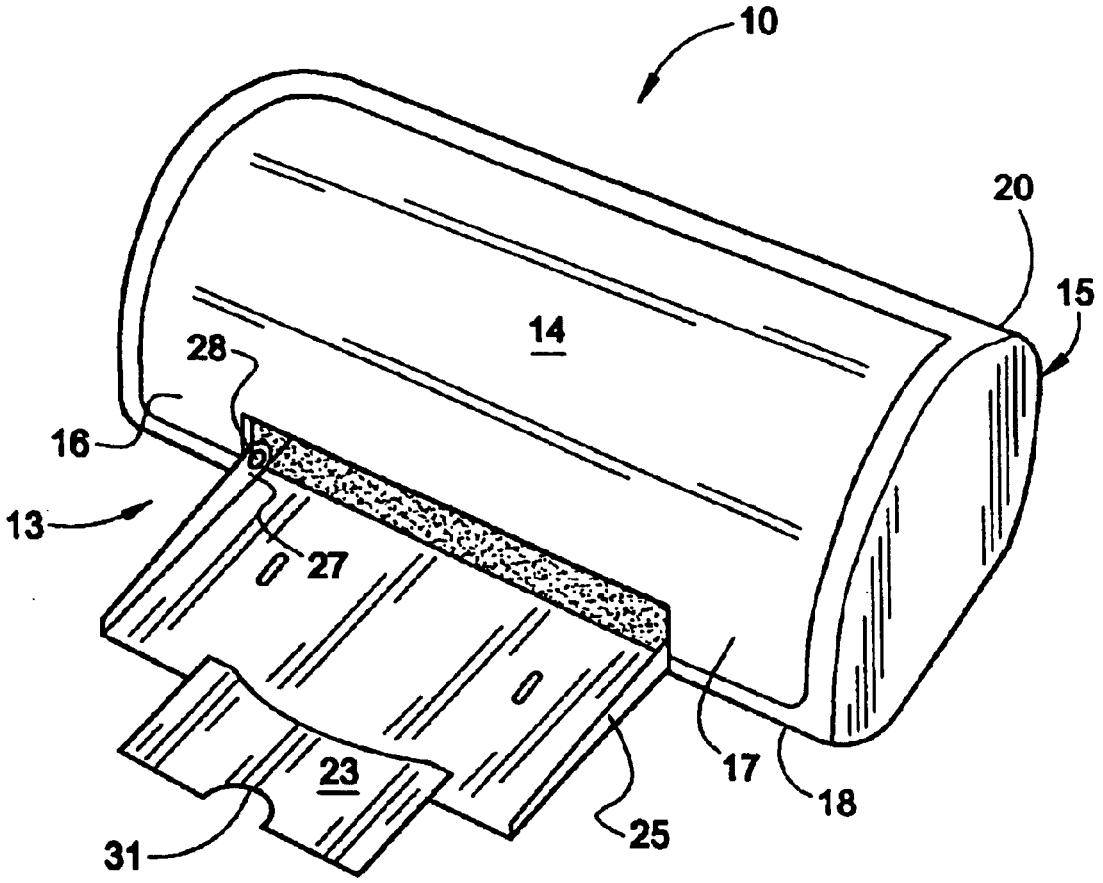
FIG. 5 is a front elevational view of the printer of FIG. 1 showing the cover closed and the print media tray in the printer operational position.

As best shown in FIGS. 4 and 5, the tray 13 includes a flat body portion 21 having short sidewalls 24 and 25 for aiding in positioning the print media (not shown) during printer 10 operation. A tray extension 23, pivotally attached to the upper surface of the tray body 21, enables the tray 13 to support print media having a variety of lengths. An arcuate cutout 31 in the extension 23 aids the user in adding to, or removing print media from, the tray 13. Attaching means, such as a hinge pin 28 extending through an opening 27 formed in the tray sidewall 24, fix the tray 13 to a side surface 19 of the front wall 12 to enable rotatable movement of the tray 13.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A printer comprising:

a housing including a bottom wall, a front wall, and a cover pivotally attached to said housing, said cover pivotable between an open and a closed position; and a tray pivotally attached to said housing for movement between a printer operational position wherein the tray extends outside of the housing and a printer non-operational position, wherein said front wall contains said tray when said tray is in said printer non-operational position and said cover is pivoted to the closed position overlying said tray.

2. The printer according to claim 1 wherein said tray is attached to said housing adjacent said bottom wall.

3. The printer according to claim 1 wherein said tray is moveable from said printer non-operational position to said printer operational position when said tray is rotated to a position wherein said tray is in substantially parallel relationship to the plane of said bottom wall.

4. The printer according to claim 1 wherein said tray is moveable from said printer operational position to said printer non-operational position when said tray is rotated to a position wherein said tray is in substantially perpendicular relationship to the plane of said bottom wall.

5. The printer according to claim 1 wherein said printer includes a top wall and said cover is attached to said printer adjacent said top wall.

6. The printer according to claim 1 wherein said tray includes a pair of sidewalls for supporting said print media.

7. The printer according to claim 6 including means for attaching said sidewalls to said housing.

8. The printer according to claim 7 wherein said wherein means for attaching include an opening formed in a sidewall and a hinge pin extending through said opening and into said housing.

9. The printer according to claim 1 wherein said tray includes a tray extension pivotally attached thereto.

10. The printer according to claim 1 wherein said cover includes a finger engageable tab for aiding in moving said cover.

11. A method of reducing the footprint of a printer comprising:

providing a printer having a housing including a front wall, a bottom wall, and a cover;

installing a tray for supporting print media from below, wherein said tray is attached to said housing for pivotal movement between a printer operational position wherein the tray extends outside of the housing and a printer non-operational position wherein the front wall contains said tray when said tray is in said non-operational position and said cover is pivoted to a closed position overlying said tray; and pivoting said tray into the printer non-operational position wherein said front wall contains said tray when said cover is rotated to the closed position and said cover overlies said tray when said tray is in said printer non-operational position.

12. The method according to claim 11 including a step of rotating said tray to a position substantially parallel to the plane of said bottom wall to transform said tray from said non-operational position to an operational position.

13. The method according to claim 11 including a step of rotating said tray to a position perpendicular to the plane of said bottom wall to transform said tray from said operational position to a non-operational position.

* * * * *